US011639826B2

(12) United States Patent
Anderson et al.

(10) Patent No.: US 11,639,826 B2
(45) Date of Patent: May 2, 2023

(54) SIDE EXITS FOR MULTI-PASS DRYERS

(71) Applicant: Hewlett-Packard Development Company, L.P., Spring, TX (US)

(72) Inventors: Ronald R. Anderson, Corvallis, OR (US); Heather Stokes, Corvallis, OR (US); Robert K. Saathoff, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/558,904

(22) Filed: Dec. 22, 2021

(65) Prior Publication Data

US 2022/0113089 A1 Apr. 14, 2022

Related U.S. Application Data

(63) Continuation of application No. 17/255,651, filed as application No. PCT/US2019/016625 on Feb. 5, 2019, now Pat. No. 11,248,843.

(51) Int. Cl.
*F26B 13/00* (2006.01)
*B41J 11/00* (2006.01)

(52) U.S. Cl.
CPC ..... *F26B 13/006* (2013.01); *B41J 11/002* (2013.01)

(58) Field of Classification Search
CPC ..... F26B 13/006; B41J 11/002
See application file for complete search history.

(56) References Cited

U.S. PATENT DOCUMENTS

| | | | | |
|---|---|---|---|---|
| 5,507,104 | A | 4/1996 | Skaugen et al. | |
| 5,832,625 | A | 11/1998 | Skaugen et al. | |
| 7,648,294 | B2 | 1/2010 | Silverbrook | |
| 8,011,780 | B2 | 9/2011 | Silverbrook et al. | |
| 9,669,616 | B2 | 6/2017 | Engelmann | |
| 9,908,342 | B1 | 3/2018 | Boland et al. | |
| 2013/0077126 | A1 | 3/2013 | Gobeyn | |
| 2015/0138288 | A1* | 5/2015 | Chen | B41J 2/515 347/102 |
| 2017/0157951 | A1 | 6/2017 | Onodera | |
| 2018/0229514 | A1 | 8/2018 | Boland et al. | |

FOREIGN PATENT DOCUMENTS

| | | | |
|---|---|---|---|
| CH | 373726 | A | 12/1963 |
| CN | 102834269 | A | 12/2012 |
| CN | 103597140 | A | 2/2014 |
| CN | 205425705 | U | 8/2016 |
| EP | 1317344 | A1 | 6/2003 |
| GB | 0937973 | A | 9/1963 |
| JP | 2014069573 | A | 4/2014 |
| KR | 10-0866597 | B1 | 11/2008 |
| WO | 94/16276 | A1 | 7/1994 |

* cited by examiner

*Primary Examiner* — Bradley W Thies

(57) ABSTRACT

In example implementations, a printing device is provided. The printing device includes a printer module, a plurality of dryer modules, and a side exit unit. The printer module is to print on a continuous web of print media. The plurality of dryer modules is located downstream from the printer module. The continuous web of print media is fed in a wrap-around direction from an outermost dryer module to a center dryer module. The side exit unit is coupled to the center dryer module to redirect the continuous web of print media along an outer side of the plurality of dryer modules.

20 Claims, 5 Drawing Sheets

100

SIDE EXITS FOR MULTI-PASS DRYERS

BACKGROUND

Print devices can be used to print images or text onto print media. Print devices can come in a variety of different forms and use different types of printing agents (e.g., ink, toner, and the like). For example, some print devices may be multi-function devices that can provide different functions include fax, copy, print, and the like.

Some print devices may be capable of printing on both sides of a print media. For example, the printer may have a paper path that flips the print media. The print device may then print an image or ink on the opposite side of the print media.

DETAILED DESCRIPTION

Examples described herein provide side exit units for printing devices with multi-pass dryers. In some print applications, large continuous webs of print media may be fed to a printing device. The printing device may use a drying system that may have a paper path that wraps around the drying system towards a center of the drying system. However, some drying systems may use a complicated system to return the print media to the printheads for further processing or to a feed collector. The complicated system may add unnecessary size and length to return the print media.

The present disclosure provides a side exit unit to allow the print media to exit towards a side of the multi-pass dryers. For example, the multi-pass dryers may use multiple drying modules where the print media may travel from an outer-most dryer module and be wrapped around towards a center-most dryer module. The side exit unit may include a plurality of turn bars that move the print media 90 degrees towards a side and then another 90 degrees towards a desired direction (e.g., back to the print heads to process a side B or towards a feed collector when printing on both sides of the print media is completed). Thus, the side exit units of the present disclosure provide a more efficient way to return the print media in printing devices that use multi-pass dryers.

Figure 1:
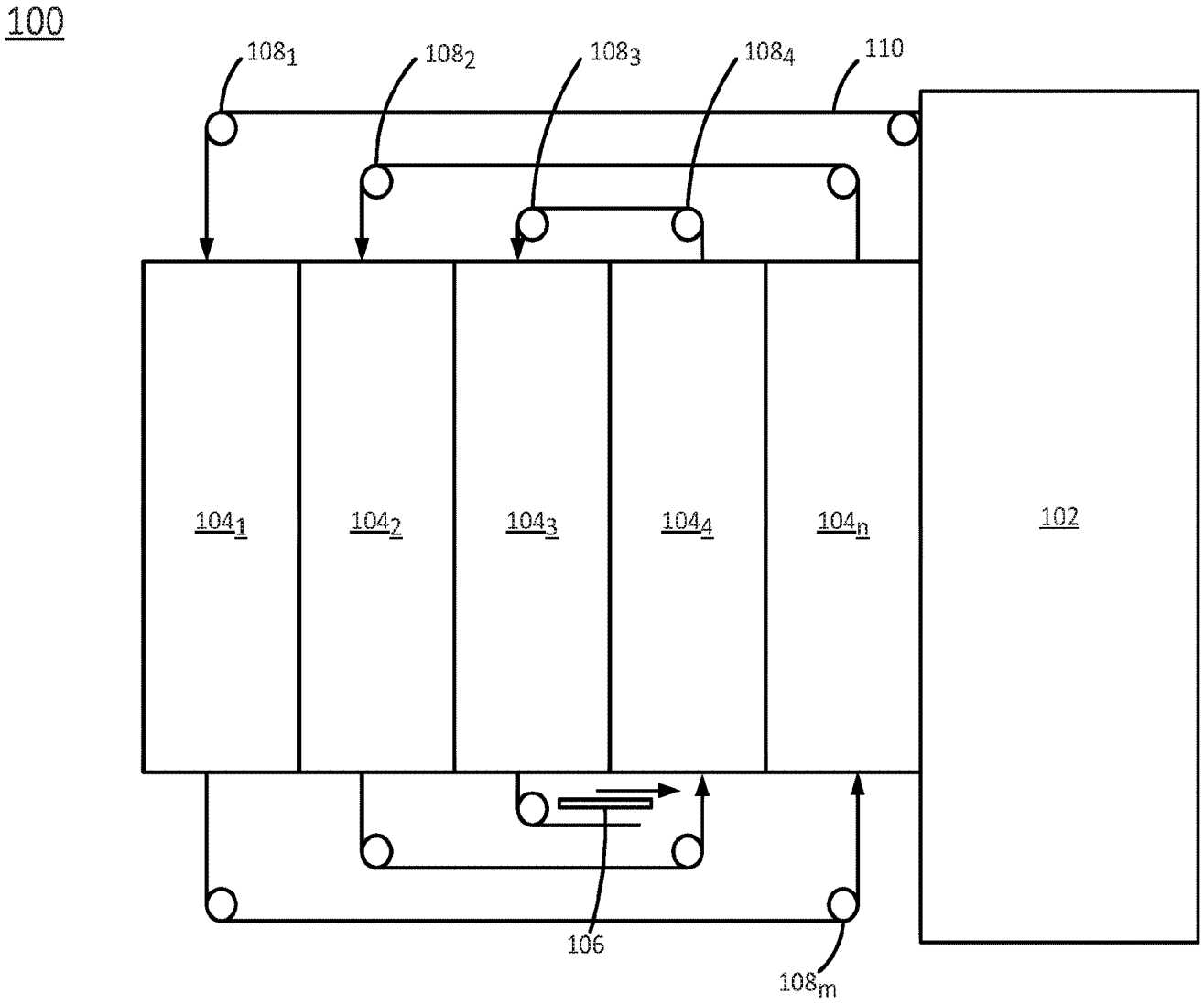
FIG. 1 is a block diagram of a side view of a multiple-pass dryer of a printing device of the present disclosure.

FIG. 1 illustrates an example printing device 100 of the present disclosure. In one example, the printing device 100 may include a printer module 102 and a plurality of dryer modules $\mathbf{104}_1$ to $\mathbf{104}_n$ (also referred to herein individually as a dryer module 104 or collectively as dryer modules 104).

It should be noted that the printing device 100 has been simplified for ease of explanation. The printing device 100 may also include additional components that are not shown in FIG. 1. For example, the printing device 100 may include print bars in the printer module 102 with printheads, driver rollers, idler rollers, a turn bar module, a controller or processor to control operation of the printing device 100, user interfaces and/or displays, and the like.

In one example, the printing device 100 may use the plurality of dryer modules 104 to perform a multiple pass drying process on a print media 110. The print media 110 may be a continuous web of print media that is fed from a roll of the print media 110 through the printer module 102. The print media 110 may be paper or any other type of media on a continuous roll that can receive print fluid from printheads in the printer module 102.

A side of the print media 110 may receive the print fluid in the printer module 102 in accordance with a print job. The print media 110 may then be fed through the dryer modules 104 as shown in FIG. 1. Although five dryer modules 104 are illustrated in FIG. 1, it should be noted that any number of dryer modules 104 may be deployed for a particular printing application or printing device 100.

In one example, a plurality of rollers $\mathbf{108}_1$-$\mathbf{108}_m$ (also referred to herein individually as a roller 108 or collectively as rollers 108) may transport the print media 110 through the dryer modules 104 in a wrap-around direction. For example, the print media 110 may exit the printer module 102 and be fed to the outermost dryer module $\mathbf{104}_1$ that is furthest from the printer module 102. The print media 110 may travel through the dryer module $\mathbf{104}_1$ and exit out a bottom of the dryer module $\mathbf{104}_1$.

The print media 110 may then travel to the innermost dryer module $\mathbf{104}_n$ that is closest to the printer module 102. The print media 110 may be fed from a bottom of the dryer module $\mathbf{104}_n$ and exit out of a top of the dryer module $\mathbf{104}_n$. The print media 110 may then travel to the dryer module $\mathbf{104}_2$ that is second furthest away from the printer module 102, or adjacent to the dryer module $\mathbf{104}_1$. The print media 110 may be fed through a top of the dryer module $\mathbf{104}_2$ and exit a bottom of the dryer module $\mathbf{104}_2$.

The print media 110 may then travel to the dryer module $\mathbf{104}_4$ in a similar fashion and be wrapped around through the dryer modules 104 until reaching a center-most dryer module (e.g., the dryer module $\mathbf{104}_3$). The print media 110 may be fed through the center-most dryer module $\mathbf{104}_3$ and exit through a bottom of the center-most dryer module $\mathbf{104}_3$.

Although an example of a multiple-pass drying process is illustrated in FIG. 1 and described above, it should be noted that the print media 110 may travel in other routes that internally wrap the print media 110 around a plurality of dryer modules 104 for the multiple-pass drying process. For example, the printer module 102 may feed the print media 110 initially from a bottom of the dryer module $\mathbf{104}_1$ such that the print media 110 exits out of a top of the center-most dryer module $\mathbf{104}_3$. In another example, the printer module 102 may initially feed the print media 110 to the closest dryer module 104*n* and then wrap the print media 110 around the dryer modules 104 to exit out of the center-most dryer module $\mathbf{104}_3$, and so forth.

One way to transport the print media 110 from the exit of the center most dryer module $\mathbf{104}_3$ may be to add additional transport rollers and paper paths to loop back around the dryer modules 104 to a destination. However, this can add costs to the printing device 100, increase the size and footprint of the printing device 100, and add complexity to the overall design of the printing device 100.

In one example of the present disclosure, a side exit unit 106 may be coupled to the exit of a center-most dryer module (e.g., the dryer module $\mathbf{104}_3$). The side exit unit 106 may guide the print media 110 along an outer edge or side of the dryer modules 104. In other words, the side exit unit 106 may guide the print media 110 outside of a dryer paper path that the print media 110 travels as it is being wrapped around the dryer modules 104, as described above.

It should be noted that the rollers 108 do not contact a side of the print media 110 that is printed on while transporting the print media 110 through the dryer modules 104. After the print media 110 exits the final dryer module (e.g., the dyer module $\mathbf{104}_3$), the side of the print media 110 that receives the print fluid from the printer module 102 may contact a turnbar (discussed below and illustrated in FIGS. 3 and 4) in the side exit unit 106.

Figure 2:
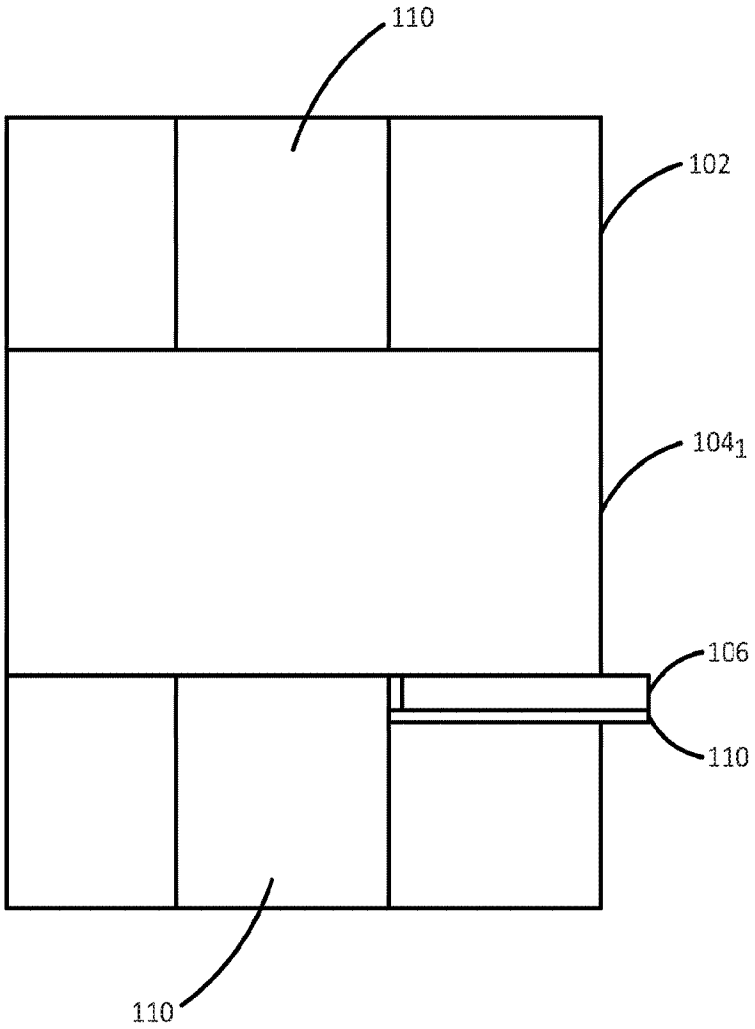
FIG. 2 is a block diagram of an end view of the example printing device of the present disclosure.

FIG. 2 illustrates an end view of the printing device 100. For example, FIG. 2 illustrates a view looking at an end of the printing device 100 where the dryer module $\mathbf{104}_1$ is closest to the reader and the printer module 102 is furthest away from the reader. The print media 110 can be seen travelling in a wrap-around direction. The print media 110 may be positioned in a center, or towards a center, of the printer modules 104 as it travels in the wrap-around direction described above.

FIG. 2 illustrates an example of the side exit unit 106 that is located below the dryer modules 104. As noted above, the side exit unit 106 may be positioned to receive the print media 110 from the final dryer module. In one example, the final dryer module may be the center-most dryer module (e.g., the dryer module $\mathbf{104}_3$) when the print media 110 is processed in a wrap-around direction through the dryer modules 104, as described above.

The side exit unit 106 may redirect the print media 110 to travel outside of the wrap-around direction that is towards a center of the dryer modules 104. In other words, the side exit unit 106 may redirect the print media 110 to travel along an outer side or outer edge of the dryer modules 104.

Figure 3:
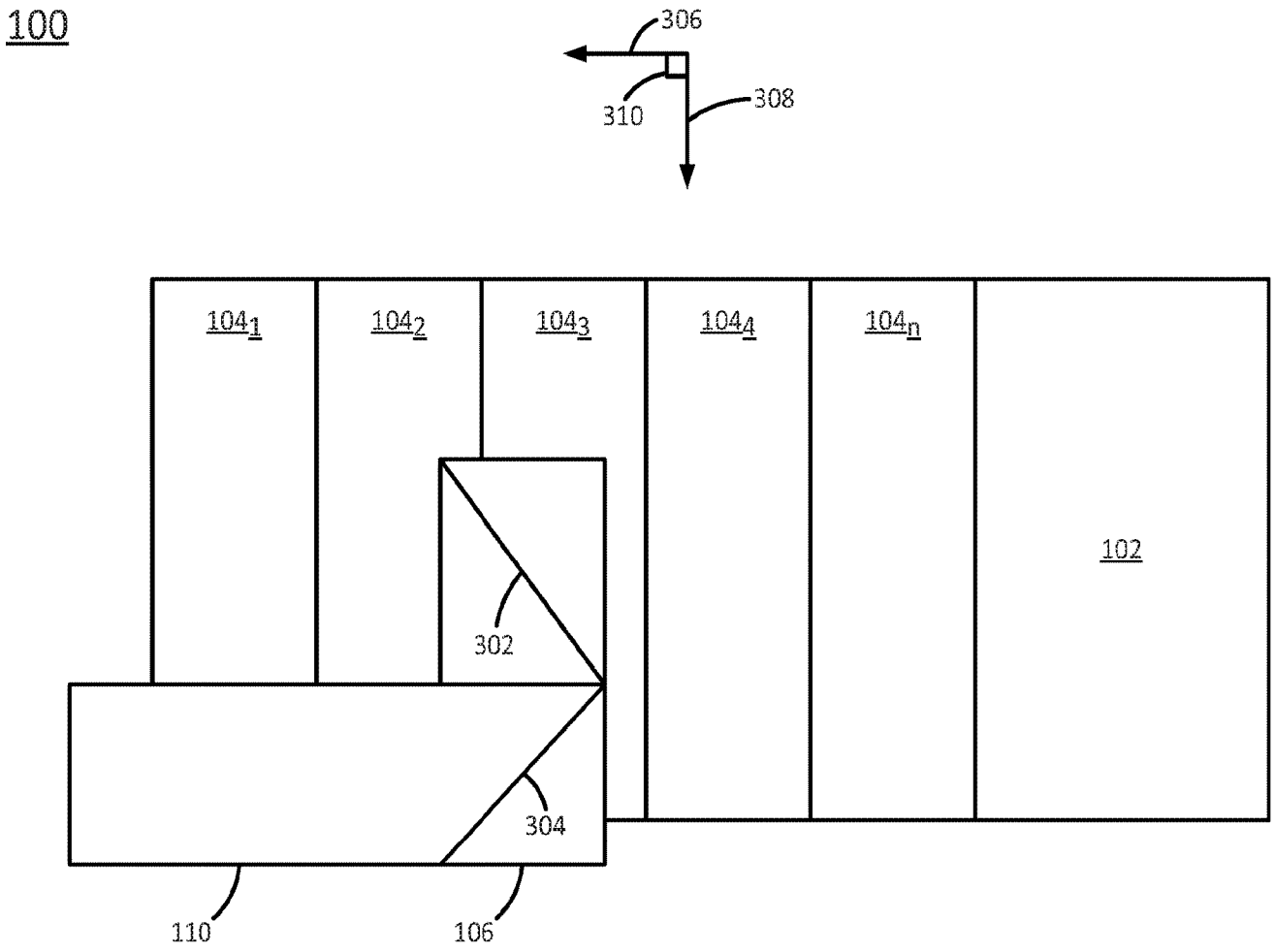
FIG. 3 is a block diagram of a bottom view of the example printing device of the present disclosure.

FIG. 3 illustrates a bottom view of the printing device 100. In one example, the printing device 100 may be a single pass printer. In other words, the print media 110 may pass through the printer module 102 a single time to print on one side of the print media 110. After the print media 110 is dried by the dryer modules 104 traveling in the wrap-around direction, the print media 110 may be fed to a collector or other finishing module of the printing device 100.

FIG. 3 illustrates the side exit unit 106. In one example, the side exit unit 106 may include a plurality of turnbars 302 and 304. The turn bars 302 and 304 may be positioned at approximately opposing 45 degree angles relative to a direction of the print media 110. The turn bars 302 and 304 may be used to redirect the print media 110 90 degrees relative to the direction of the print media 100. In one example, the turn bars 302 and 304 may be arranged to be parallel relative to each other to redirect the print media 110 in consecutive 90 degree turns. As a result, the print media 110 may be rerouted along an outer side of the dryer modules 104 towards a collector or other finishing module.

In one example, the angles may be defined by axes 306 and 308 illustrated in FIG. 3. The axes 306 and 308 may represent a direction that the print media 110 may travel along in the printing device 100. An angle 310 may be defined relative to the axes 306 and 308. For example, when the print media 110 is traveling along a direction parallel to the axis 306, redirecting the print media 110 by 90 degrees may cause the print media 110 to travel along a direction that is parallel to the axis 308. The angle 310 formed between the axes 306 and 308 may be approximately 90 degrees.

To illustrate, the print media 110 may exit the dryer module $\mathbf{104}_3$ after completing the drying process in a wrap-around direction described above. The print media 110 may exit the dryer module $\mathbf{104}_3$ traveling in a direction parallel to the axis 306. The print media 110 may be fed through a first turnbar 302 in the side exit unit 106 to redirect the print media 110 by 90 degrees so that the print media 110 travels in a direction parallel to the axis 308.

The print media 110 may be fed through a second turnbar 304 in the side exit unit 106 to redirect the print media 110 by another 90 degrees. As a result, the print media 110 may travel in a direction that is parallel to the axis 306.

As noted above, the print media 110 may be a continuous web of print media. Thus, portions of the print media 110 may be still traveling through the center of the dryer modules 102 as other portions of the print media 110 are be redirected by the side exit unit 106.

In one example, the second turnbar 304 may be positioned away from the first turnbar 302 such that the print media 110 travels outside of the portion of the print media 110 that may be still traveling through the dryer modules 104 in the wrap-around direction. In other words, the print media 110 may travel along a direction parallel to the axis 308 for a distance sufficient to clear the outer edge of the portion of the print media 110 that may be located towards a center of the dryer modules 104. Once the print media 110 has cleared the portion of the print media 110 still traveling through the dryer modules 104, the second turnbar 304 may redirect the print media 110 through a second 90 degree turn towards a final destination of the print media 110.

Figure 4:
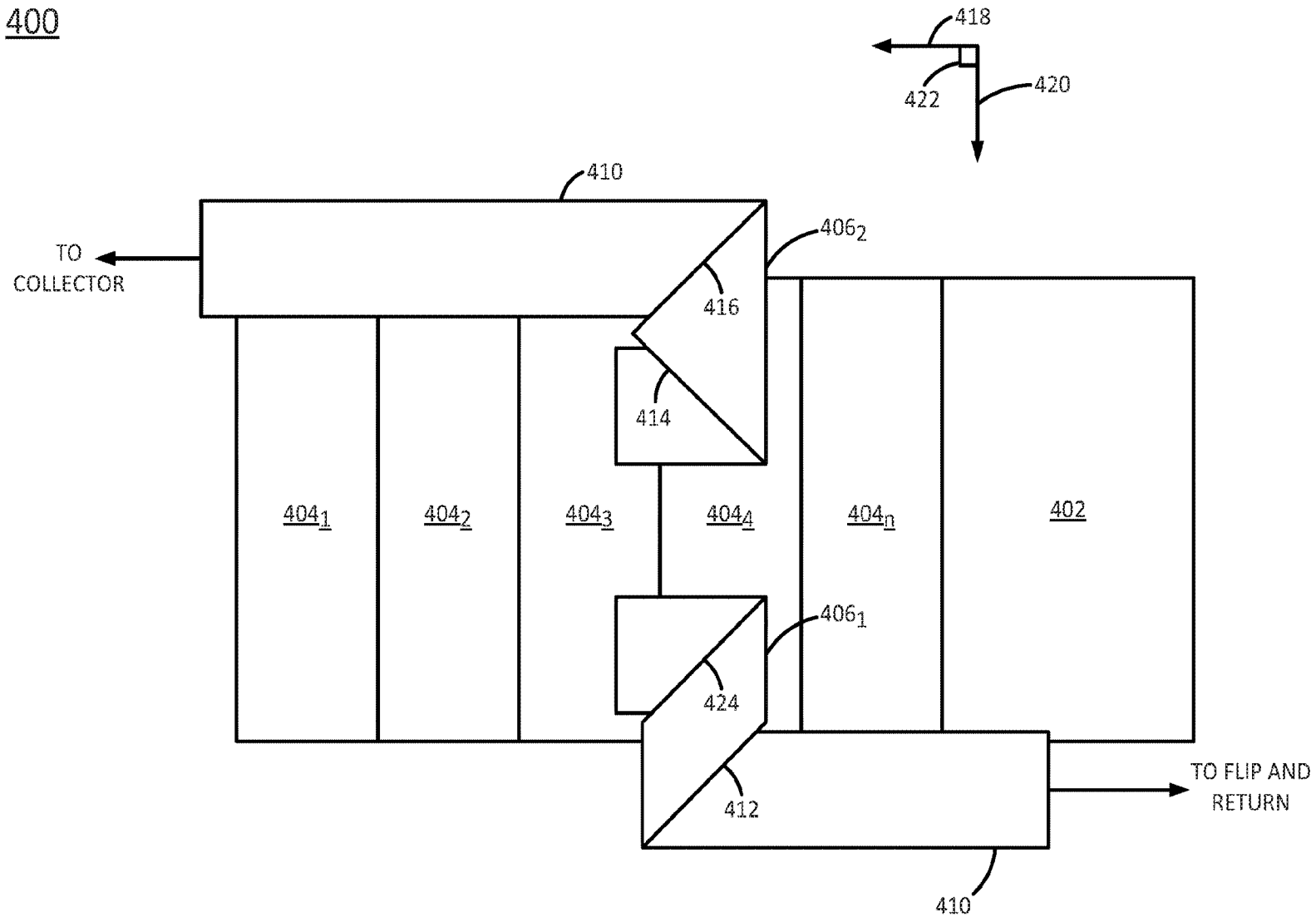
FIG. 4 is a block diagram of a bottom view of another example printing device of the present disclosure.

FIG. 4 illustrates a bottom view of an example printing device 400. The printing device 400 may be similar to the printing device 100 except that the printing device 400 may be a multiple-pass or side-by-side printer. For example, the printing device 400 may include a printer module 402 and a plurality of dryer modules $\mathbf{404}_1$-$\mathbf{404}_n$. The printer module 402 may include print bars that are capable of printing on both sides of a print media 410.

The print media 410 may be a continuous roll of print media that is continuously fed through the printing device 400. The print media 410 may be initially fed through the printer module 402 and the printer module 402 may print on a first side of the print media 410. The print media 410 may then travel through the dryer modules 404 in a wrap-around direction to dry the print fluid dispensed on the first side of the print media 410, as described above. The print media 410 may then be flipped and returned to the printer module 402.

The printer module 402 may print on a second side of the print media 410. The print media 410 may then be fed through the dryer modules 404 in a wrap-around direction to dry the printing fluid dispensed on the second side of the print media 410, as described above.

In one example, the dryer modules 404 may have two wrap-around directions or paths. One wrap-around direction may be for the drying the first side of the print media 410 after the printer module 402 and a second wrap-around direction may be for drying the second side of the print media 410 after the printer module 402. The two wrap-around paths may be adjacent and parallel to one another towards a center of the dryer modules 404.

As a result, the printing device 400 may include two side exit units $\mathbf{406}_1$ and $\mathbf{406}_2$. The side exit units $\mathbf{406}_1$ and $\mathbf{406}_2$ may be located below the center-most dryer module (e.g., the dryer module $\mathbf{404}_3$). The side exit units $\mathbf{406}_1$ and $\mathbf{406}_2$ may be positioned to receive the print media 410 as the print media exits the center-most dryer module $\mathbf{404}_3$.

In one example, the side exit unit $\mathbf{406}_1$ may include turnbars 424 and 412. The side exit unit $\mathbf{406}_2$ may include turnbars 414 and 416. The first side exit unit $\mathbf{406}_1$ may receive the print media 410 after the first side is dried by the dryer modules 404. The turnbars 424 and 412 may be aligned approximately parallel at 45 degrees relative to the direction of the print media 410. FIG. 4 illustrates axes 418 and 420 that form an angle 422 to provide context for the angles, as described in FIG. 3 and discussed above.

In one example, the turnbars 424 and 412 may redirect the print media 410 in two consecutive 90 degree turns to redirect the print media 410 back towards a flip and return unit (not shown). For example, the print media 410 may travel in a direction parallel to the axis 418. The turnbar 424 may receive the print media 410 and turn the print media 410 by 90 degrees such that the print media 410 travels in a direction parallel to the axis 420. The turnbar 412 may receive the print media 410 and turn the print media 410 by another 90 degrees such that the print media 410 travels in a direction parallel (but opposite) to the axis 418, as illustrated in FIG. 4.

The turnbar 412 may be positioned away from the turnbar 424 such that the print media 410 travels outside of the portion of the print media 410 that may be still traveling through the dryer modules 404 in the wrap-around direction. In other words, the print media 410 may travel along a direction parallel to the axis 420 for a distance sufficient to clear the outer edge of the portion of the print media 410 that may be located towards a center of the dryer modules 404. Once the print media 410 has cleared the portion of the print media 410 still traveling through the dryer modules 404, the turnbar 412 may redirect the print media 410 through a second 90 degree turn towards the flip and return unit.

As noted above the second side exit unit $\mathbf{406}_2$ may include the turnbars 414 and 416. The turnbars 414 and 416 may be aligned approximately opposing 45 degree angles relative to the direction of the print media 410.

In one example, the turnbars 414 and 416 may redirect the print media 410 in two consecutive 90 degree turns to redirect the print media 410 towards a collector or a final destination. For example, the print media 410 may travel in a direction parallel to the axis 418. The turnbar 414 may receive the print media 410 and turn the print media 410 by 90 degrees such that the print media 410 travels in a direction parallel to the axis 420. The turnbar 416 may receive the print media 410 and turn the print media 410 by another 90 degrees such that the print media 410 travels in a direction parallel to the axis 418, as illustrated in FIG. 4.

The turnbar 416 may be positioned away from the turnbar 414 such that the print media 410 travels outside of the portion of the print media 410 that may be still traveling through the dryer modules 404 in the wrap-around direction. In other words, the print media 410 may travel along a direction parallel to the axis 420 for a distance sufficient to clear the outer edge of the portion of the print media 410 that may be located towards a center of the dryer modules 404. Once the print media 410 has cleared the portion of the print media 410 still traveling through the dryer modules 404, the turnbar 416 may redirect the print media 410 through a second 90 degree turn towards the collector.

Thus, the first side exit unit $\mathbf{406}_1$ and the second side exit unit $\mathbf{406}_2$ may redirect the print media 410 to travel on opposite outer sides of the dryer modules 404 in the respective directions. The side exit units $\mathbf{406}_1$ and $\mathbf{406}_2$ may provide an elegant solution to exiting the print media 410 from a center-most dryer module $\mathbf{404}_3$ after the wrap-around drying process is completed.

Figure 5:
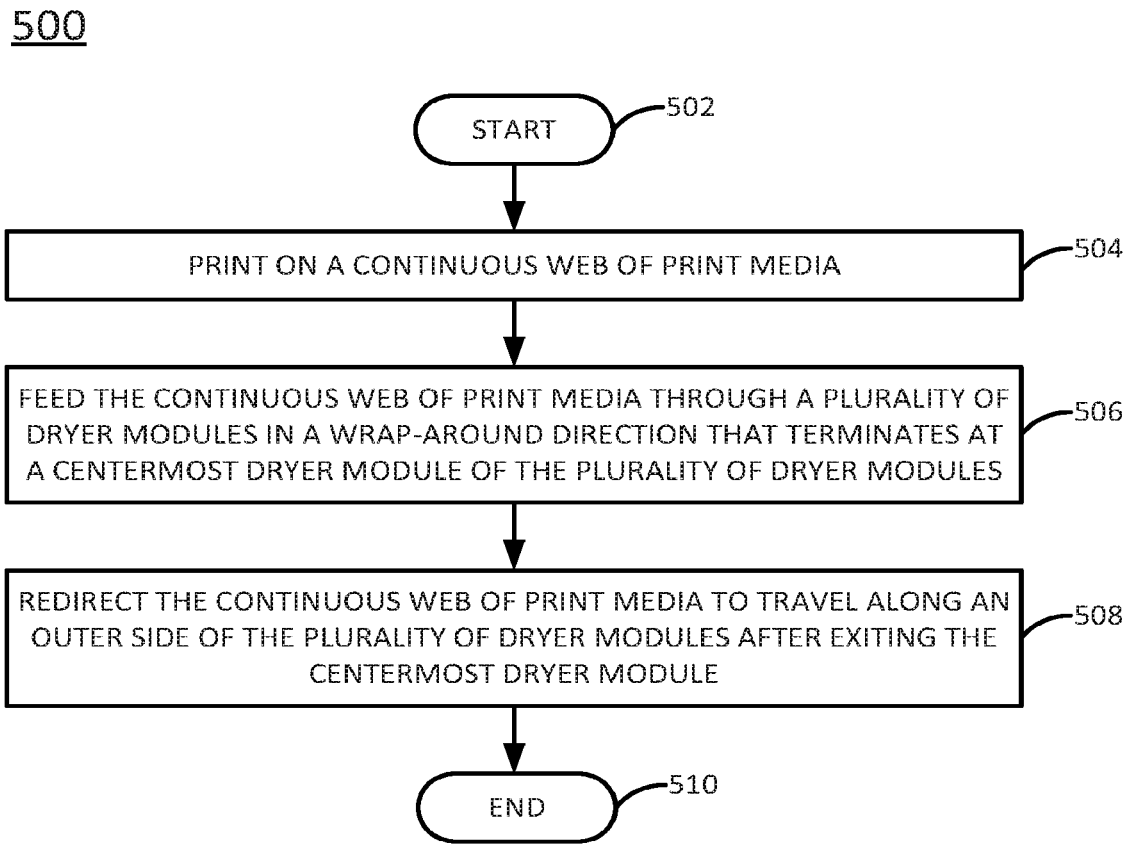
FIG. 5 is a flow chart of an example method for redirecting a continuous web of print media along an outer side of a multiple-pass dryer module of the present disclosure.

FIG. 5 illustrates a flow diagram of an example method 500 for redirecting a continuous web of print media along an outer side of a multiple-pass dryer module. In an example, the method 500 may be performed by the printing device 100 or 400.

At block 502, the method 500 begins. At block 504, the method 500 prints on a continuous web of print media. For example, the print media may be a continuous roll of paper that is fed through a printing device. The printing device may be a single pass printing device or a double pass printing device that can print on both sides of the print media. For example, the printing device may print on both sides of the print media simultaneously in a side-by-side fashion. The printing device may dispense a printing fluid onto the print media in accordance with a print job.

At block 506, the method 500 feeds the continuous web of print media through a plurality of dryer modules in a wrap-around direction that terminates at a centermost dryer module of the plurality of dryer modules. For example, the wrap-around direction may include directing the print media through the plurality of dryer modules in a continuous loop moving from the outermost dryer modules to a centermost dryer module.

In one example, the continuous web of print media may be fed to a top of a dryer module that is furthest away from a printer module and out a bottom of the dryer module furthest away from the printer module. The continuous web of print media may be fed to a bottom of a dryer module closest to the printer module and out a top of the dryer module closest to the printer module. The process may be repeated as the continuous web of print media is fed through the inner dryer modules until the centermost dryer module is reached.

At block 508, the method 500 redirects the continuous web of print media to travel along an outer side of the plurality of dryer modules after exiting the center-most dryer module. For example, the redirecting may be performed by a side exit unit that includes a plurality of turnbars that may turn the continuous web of print media. In one example, each turnbar may turn the continuous web of print media approximately 90 degrees relative to a direction of travel of the continuous web of print media as it enters the turnbar.

In one example, the plurality of turnbars may be arranged to redirect the continuous web of print media twice at approximately 90 degrees. In a single-pass printing device with a single side exit unit, the plurality of turnbars may be arranged to have the continuous web of print media move towards a collector along an outer-side of the dryer modules.

In one example, the method 500 may be repeated for a double-pass printing device. For example, the double-pass printing device may print on both sides of the print media and have the print media travel through the dryer modules in two different wrap-around directions or paths. Thus, the double-pass printing device may have two side exit units.

A first side exit unit may have the plurality of turnbars which may be arranged to have the continuous web of print media move back towards the printer module if the printing device is a double-pass printing device. Then the continuous web of print media may travel through a second wrap-around direction in the plurality of dryer modules and be fed to the second side exit unit located below the center-most dryer module.

The second side exit unit may have the plurality of turnbars arranged to have the continuous web of print media move towards a collector or some other finishing module of the printing device. At block 510, the method 500 ends.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A printing device, comprising:

a printer module to print on a continuous web of print media;

a plurality of dryer modules located downstream from the printer module, wherein the continuous web of print media is fed in a wrap-around direction from an outermost dryer module to a center dryer module; and a number of rollers to feed the web through the plurality of dryer modules, the rollers arranged to only contact an unprinted side of the web.

2. The printing device of claim 1, further comprising a side exit unit coupled to the center dryer module to redirect the continuous web of print media along an outer side of the plurality of dryer modules.

3. The printing device of claim 2, wherein the side exit unit redirects the continuous web away from the printer module to a collector or other finishing module.

4. The printing device of claim 1, further comprising two side exit units coupled to the center dryer module.

5. The printing device of claim 4, wherein a first of the two side exit units comprises turnbars to redirect the web along an outside of the dryer modules back to the printer module for printing on a second side of the web.

6. The printing device of claim 5, wherein a second of the two side exit units comprises turnbars to redirect the web along an outside of the dryer modules to a collector or other finishing module.

7. The printing device of claim 4, wherein a second of the two side exit units comprises turnbars to redirect the web along an outside of the dryer modules to a collector or other finishing module.

8. The printing device of claim 5, wherein a first turnbar of the turnbars is to redirect the continuous web of print media a first 90 degrees and a second turnbar of the turnbars is to redirect the continuous web of print media a second 90 degrees.

9. The printing device, of claim 1, wherein the wrap-around direction comprises feeding the continuous web of print media to the outermost dryer module that is furthest from the printer module, then to the outermost dryer module that is closest to the printer module, then towards the center dryer module.

10. A method, comprising:

printing on a continuous web of print media;

feeding the continuous web of print media through a plurality of dryer modules in a wrap-around direction that terminates at a centermost dryer module of the plurality of dryer modules; and adding or removing dryer modules based on a drying capacity needed for a particular printing application.

11. The method of claim 10, further comprising redirecting the continuous web of print media to travel along an outer side of the plurality of dryer modules after exiting the centermost dryer module.

12. The method of claim 11, wherein the redirecting comprises:

turning the continuous web of print media with a side exit unit that comprises a plurality of turnbars.

13. The method of claim 12, wherein each one of the plurality of turnbars turns the continuous web of print media 90 degrees.

14. The method of claim 10, wherein the feeding comprises:

feeding the continuous web of print media to a top of a dryer module furthest away from a printer module and out a bottom of the dryer module furthest away from a printer module;

feeding the continuous web of print media to a bottom of a dryer module closest to the printer module and out a top of the dryer module closest to the printer module; and repeating the feeding for inner dryer modules until the centermost dryer module is reached.

15. A printing device, comprising:

a printer module to print on a continuous web of print media; and a plurality of dryer modules located downstream from the printer module, wherein the continuous web of print media is fed through the plurality of dryer modules in a wrap-around path from an outermost dryer module to a center dryer module.

16. The printing device of claim 15, further comprising a side exit unit coupled to the center dryer module to output the continuous web of print media.

17. The printing device of claim 15, further comprising two adjacent and parallel wrap-around paths from the printer module through the plurality of dryer modules.

18. The printing device of claim 17, further comprising two side exit units coupled to the center dryer module corresponding respectively to the two adjacent and parallel wrap-around paths, a first side exit unit to output the web back to the printer module for duplex printing and a second side exit unit to output the web to a finishing module.

19. The printing device of claim 18, wherein each side exit unit comprises a plurality of turnbars.

20. The printing device of claim 15, further comprising a number of rollers to feed the web through the plurality of dryer modules, the rollers arranged to only contact an unprinted side of the web.

* * * * *